US008387297B2

(12) United States Patent
deBrun et al.

(10) Patent No.: US 8,387,297 B2
(45) Date of Patent: Mar. 5, 2013

(54) QUICK CONNECT/DISCONNECT RECOIL PAD

(75) Inventors: Erik T. deBrun, Philadelphia, PA (US); J. Daniel Massam, Langhorne, PA (US)

(73) Assignee: O.F. Mossberg & Sons, Inc., North Haven, CT (US)

( * ) Notice: Subject to any disclaimer, the term of this patent is extended or adjusted under 35 U.S.C. 154(b) by 128 days.

(21) Appl. No.: 12/813,566

(22) Filed: Jun. 11, 2010

(65) Prior Publication Data

US 2011/0302817 A1 Dec. 15, 2011

(51) Int. Cl.
*F41C 23/00* (2006.01)

(52) U.S. Cl. ..... 42/74; 42/71.01

(58) Field of Classification Search ..... 42/72–74
See application file for complete search history.

(56) References Cited

U.S. PATENT DOCUMENTS

| | | | | | |
|---|---|---|---|---|---|
| 1,331,074 | A | * | 2/1920 | Marble | 42/71.01 |
| 2,661,561 | A | * | 12/1953 | Magaro | 42/70.03 |
| 2,925,679 | A | * | 2/1960 | Bivens | 42/74 |
| 3,696,544 | A | | 10/1972 | Webb | |
| 4,551,937 | A | | 11/1985 | Seehase | |
| 4,663,877 | A | | 5/1987 | Bragg | |
| 4,683,671 | A | | 8/1987 | Farrar | |
| 4,821,443 | A | | 4/1989 | Bianco | |
| 4,887,374 | A | | 12/1989 | Santarossa | |
| 5,375,360 | A | | 12/1994 | Vatterott | |
| 5,461,813 | A | | 10/1995 | Mazzola | |
| 6,305,115 | B1 | | 10/2001 | Cook | |
| 6,467,212 | B1 | * | 10/2002 | Apel | 42/74 |
| 6,497,064 | B1 | | 12/2002 | Keaton | |
| 6,564,493 | B1 | | 5/2003 | Forman | |
| 6,594,935 | B2 | * | 7/2003 | Beretta | 42/74 |
| 6,684,547 | B2 | | 2/2004 | Poff, Jr. | |
| 6,684,549 | B2 | * | 2/2004 | Bragg | 42/74 |
| 6,732,466 | B2 | * | 5/2004 | Bentley | 42/74 |
| 6,834,456 | B2 | | 12/2004 | Murello | |
| 6,889,461 | B2 | * | 5/2005 | Vignaroli et al. | 42/74 |
| 7,152,356 | B2 | | 12/2006 | Sims | |
| 2004/0031182 | A1 | * | 2/2004 | Bentley | 42/74 |
| 2011/0173863 | A1 | * | 7/2011 | Ingram | 42/73 |
| 2011/0192067 | A1 | * | 8/2011 | Troy | 42/73 |

* cited by examiner

*Primary Examiner* — Samir Abdosh
(74) *Attorney, Agent, or Firm* — Donald S. Holland, Esq.; Holland & Bonzagni, P.C.

(57) ABSTRACT

Applicants have disclosed a quick connect/disconnect recoil pad for the butt-end of a shoulder-mounted firearm. The recoil pad can be installed and removed without tools or implements, to swap in another recoil pad. Applicants' preferred embodiment comprises: an interchangeable recoil pad assembly having a recoil pad; and a spring-loaded latching means, attached to the rear or butt-end of a gun stock for connecting the recoil pad assembly onto the stock and for later quickly disconnecting the pad assembly, if desired, via a release button housed in the stock.

4 Claims, 5 Drawing Sheets

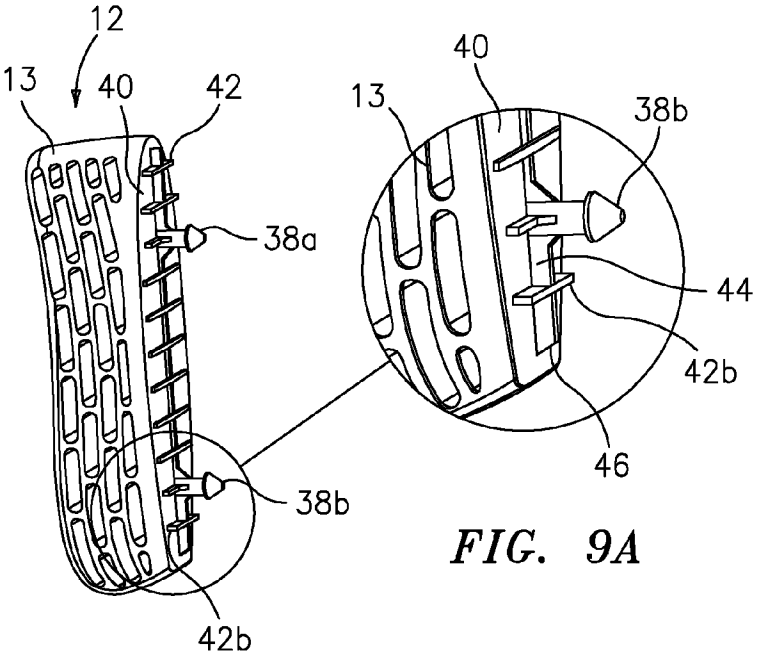
FIG. 9
FIG. 9A
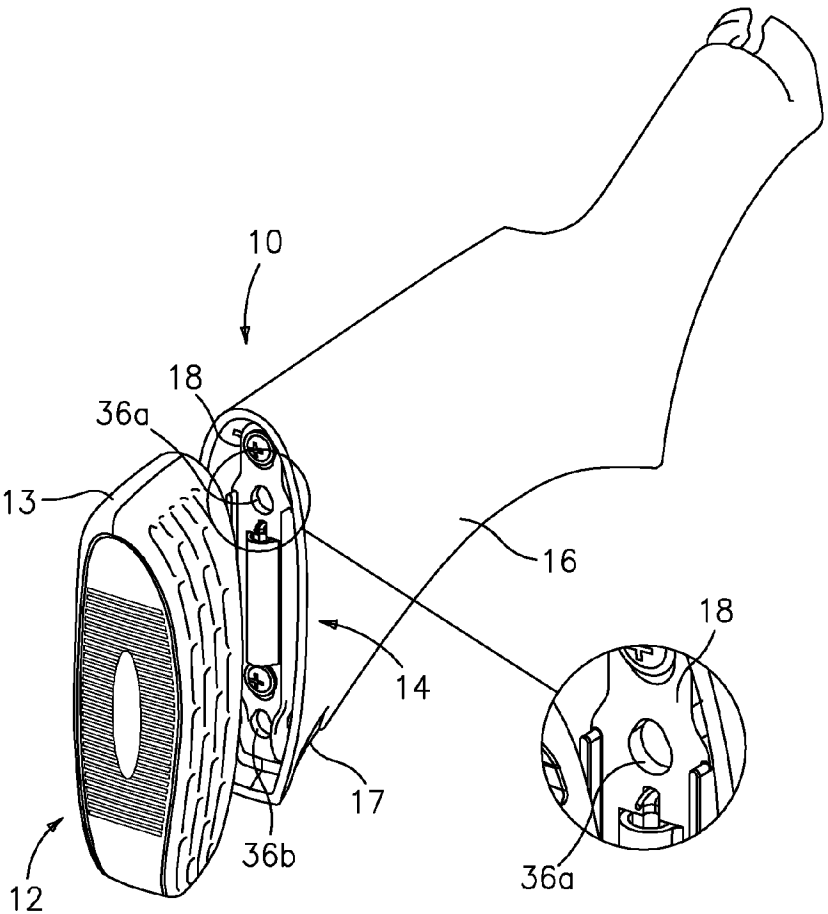
FIG. 8
FIG. 8A

QUICK CONNECT/DISCONNECT RECOIL PAD

FIELD OF INVENTION

This invention relates generally to stocks for firearms, such as shotguns and rifles. More particularly, it relates to recoil pads attachable to such stocks.

BACKGROUND OF THE INVENTION

Recoil pads are well-known for absorbing the kick encountered upon discharging a shotgun, rifle or other shoulder-fired firearm. They attach to the rear or butt-ends of gun stocks and are usually designed to rest against a shooter's shoulder.

Different recoil pads offer varying degrees of recoil absorption. By varying the thickness of the recoil pad, that can vary length of pull, the distance between the shooter's shoulder and the trigger, and the sighting characteristics, for example, the distance between the shooter's eye and the firearm eyepiece.

Experienced shooters appreciate that the positioning of a firearm with respect to the hand and sighting eye will affect the accuracy and repeatability of shots fired. Selection of different degrees of shock absorption capability will affect comfort and the ability to control the firearm between discharges. The ability to quickly change recoil pads also allows multiple shooters with differing anatomical dimensions to experience optimal shooting conditions.

Typically, recoil pads are attached to gun stocks using two screws, requiring a screwdriver to remove them. An interchangeable recoil pad appearing in U.S. Pat. No. 1,331,074 to W. L. Marble, issued Feb. 17, 1920, required the insertion of an implement to effect the disconnection of the recoil pad from the stock of the gun.

It is a primary object of Applicants' invention to provide an easy-to-use apparatus for quickly connecting or disconnecting an interchangeable recoil pad without the use of tools or implements.

It is another general object to provide such an apparatus which is durable to use.

SUMMARY OF THE INVENTION

Applicants have invented a quick connect/disconnect recoil pad assembly that attaches a recoil pad to the butt-end of a firearm stock. In the preferred embodiment, the invention comprises: a latch mechanism fitted within the butt-end of a shotgun or rifle stock; and a separate interchangeable recoil pad assembly. To remove the recoil pad assembly, a release button (preferably in the bottom of the stock) is pressed and the pad assembly is pulled off. To attach a recoil pad assembly, connecting posts on a pad substrate are aligned with pear-shaped holes in the latch and the pad assembly is pushed onto the stock, snapping into place. No tools are required.

Applicants' invention can be used with shotguns, rifles, or other shoulder-fired firearms.

BRIEF DESCRIPTION OF DRAWINGS

FIG. 8 is a cutaway view showing pear-shaped holes in the preferred latch mechanism;

FIG. 8A is a enlarged view of an encircled portion in FIG. 8;

FIG. 9 is a perspective view of the recoil pad assembly; and

FIG. 9A is an enlarged view of a connecting post, ribs and channel that help maintain the alignment of the recoil pad assembly with the latching mechanism.

DETAILED DESCRIPTION OF THE PREFERRED EMBODIMENT

Figure 2:
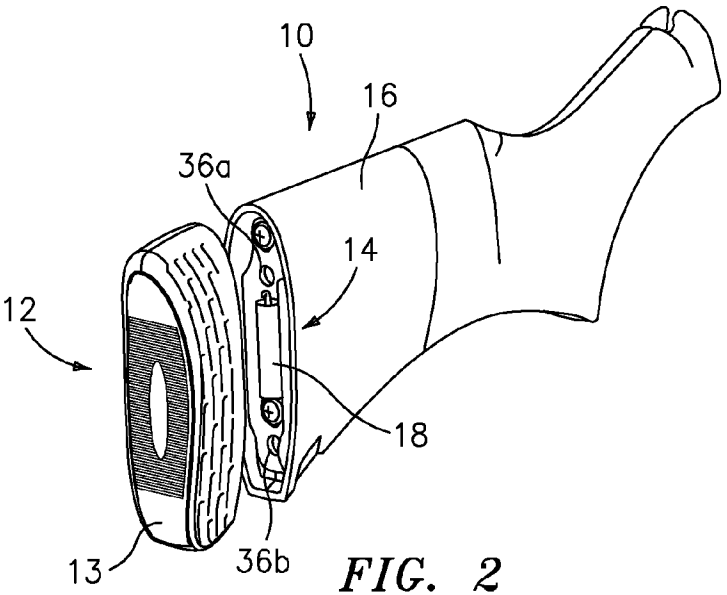
FIG. 2 is an end perspective view showing a latching mechanism, connected to a gun stock, and a disconnected recoil pad assembly.
Figure 1:
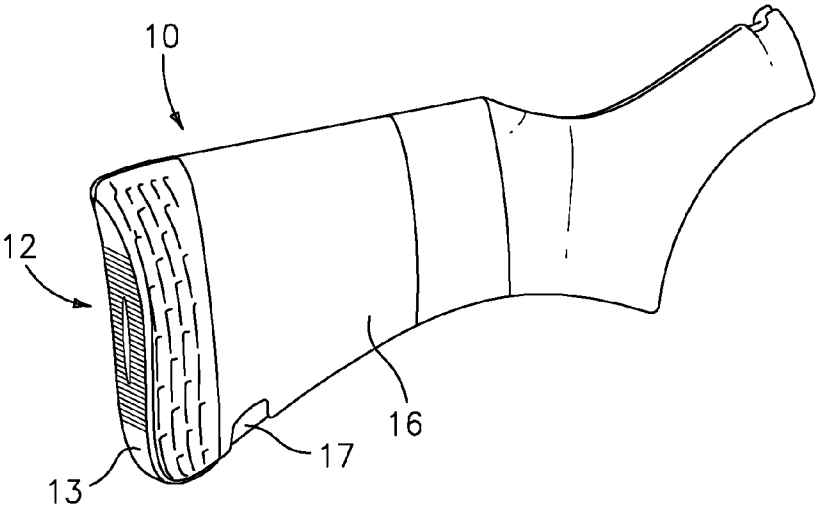
FIG. 1 is a side perspective view of a gun stock equipped with a preferred embodiment of the "Quick Connect/Disconnect Recoil Pad" constructed in accordance with Applicants' invention.
Figure 3:
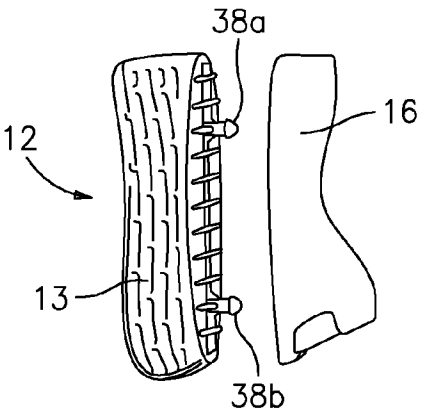
FIG. 3 is a perspective view of the disconnected recoil pad assembly showing a vertical "channel" (i.e., a longitudinal rib) and horizontal ribs that help to align the recoil pad assembly to the interior contours of the latching mechanism.
Figure 4:
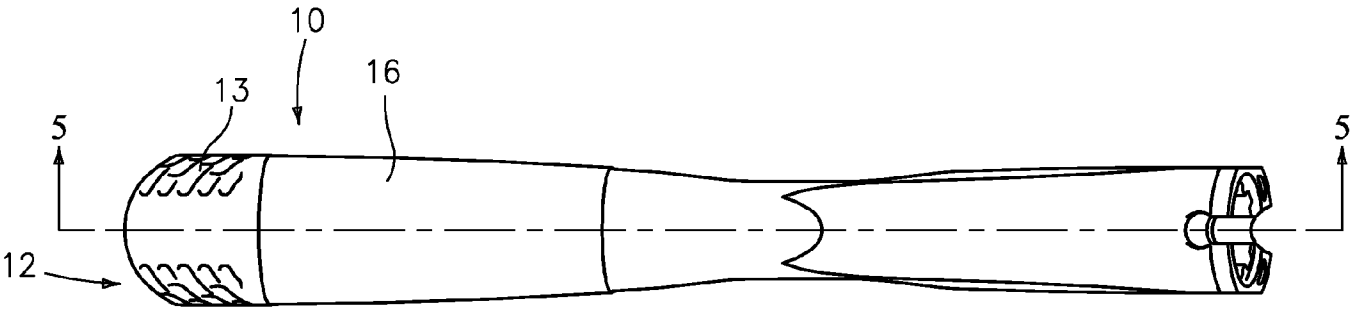
FIG. 4 is a top view of the gun stock and attached pad shown in FIG. 1.
Figure 5:
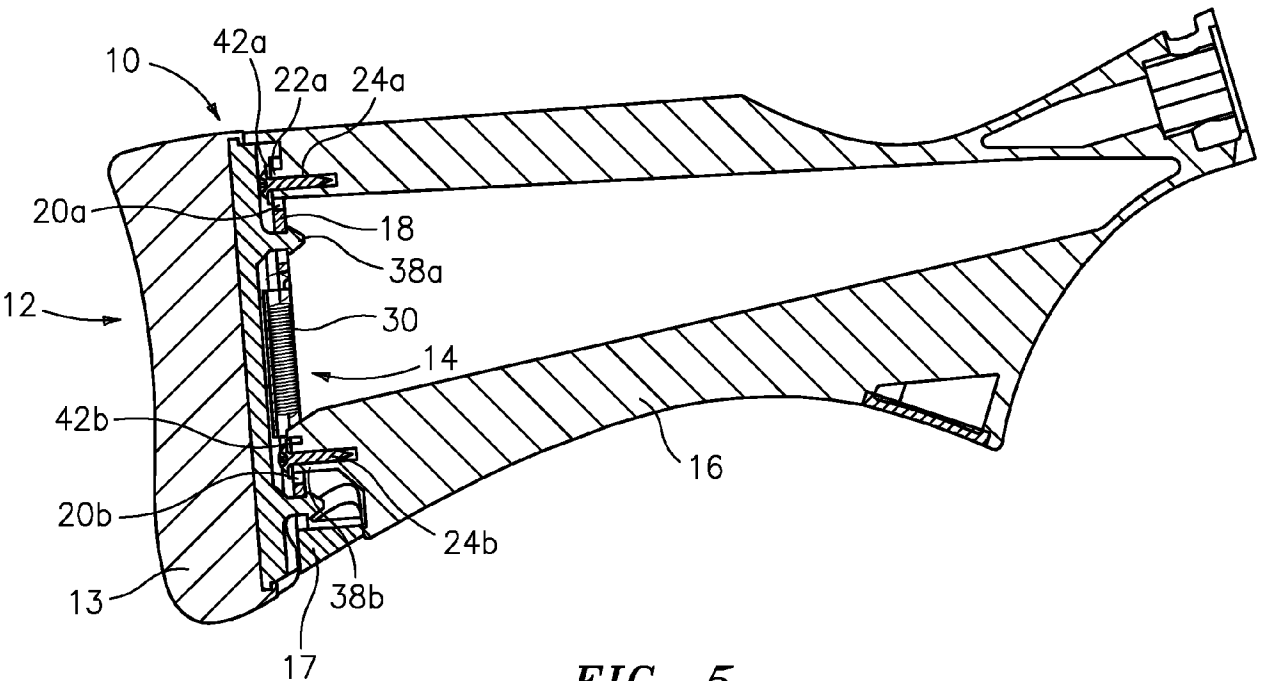
FIG. 5 is a cross-sectional side view, taken along line 5-5 of FIG. 4, showing the recoil pad assembly in place and latched in position.
Figure 6:
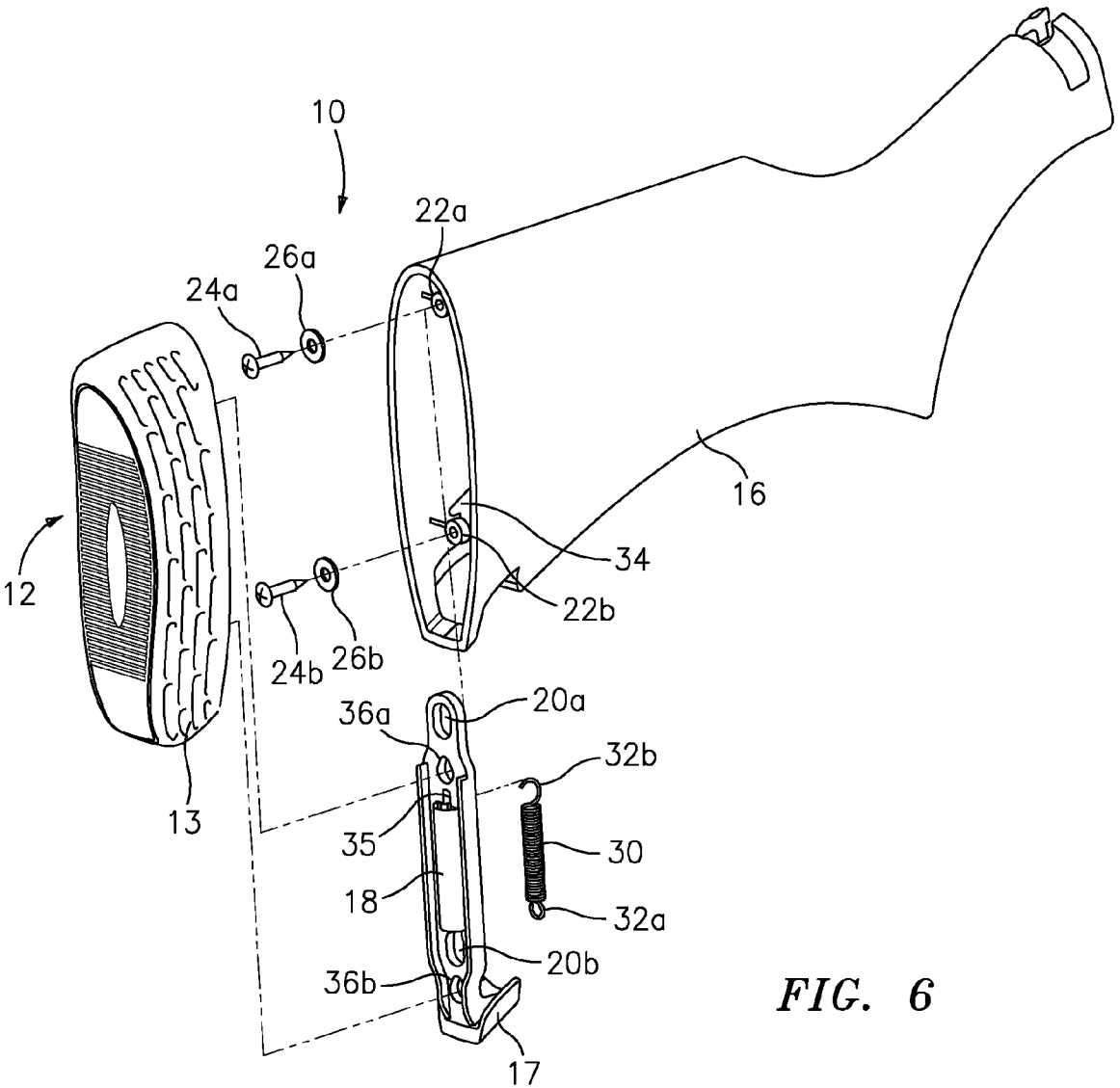
FIG. 6 is an exploded view of the latching mechanism, showing nearby a recoil pad assembly and the opened end of the gun stock.
Figure 7:
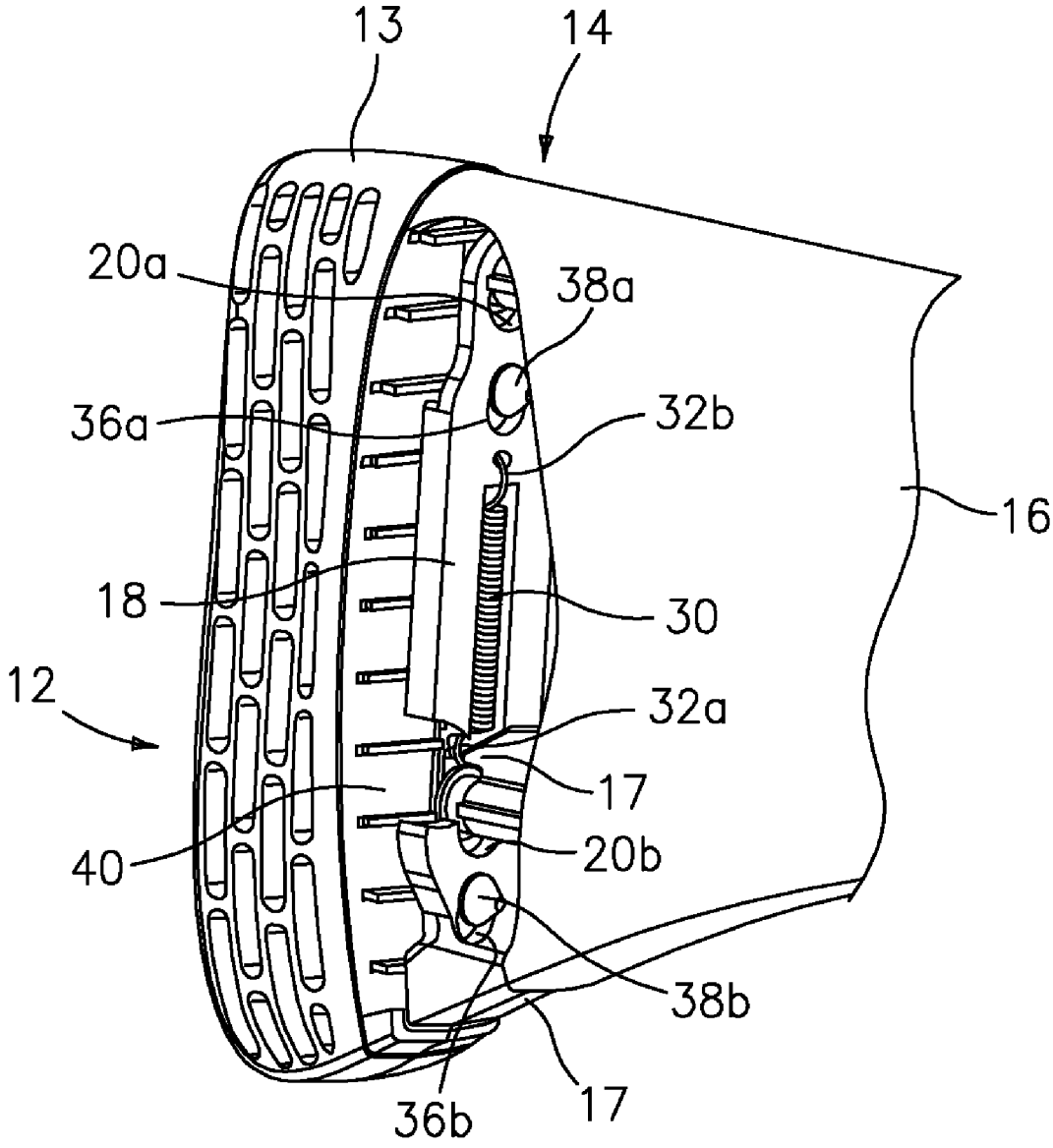
FIG. 7 is a cutaway view showing the recoil pad assembly connected to the latching mechanism.

Referring to FIGS. 1, 2, 3, 4, 5, 6, 7, 8, 8A, 9 and 9A in detail, they show a preferred embodiment 10 of Applicants' "Quick Connect/Disconnect Recoil Pad" for swapping out recoil pads for firearms without the use of any tools. Applicants' assignee, O. F. Mossberg & Sons, Inc., intends to manufacture and market the invention.

Applicants' preferred embodiment 10 broadly comprises: an interchangeable recoil pad assembly 12 having a recoil pad 13; and a latching means 14, attached to the rear of a gun stock 16, for connecting the recoil pad assembly 12 onto the stock 16 and for later quickly disconnecting the pad assembly, via a release button 17.

As best shown in FIGS. 5, 7, 8, 8A the preferred latching means 14 comprises: a latch plate 18, preferably stamped steel, having two longitudinal slots 20*a*, 20*b* (here, rectangular with rounded ends) adapted to fit over two posts 22*a*, 22*b* inside stock 16. The length of these posts 22*a*, 22*b* preferably exceeds the thickness of the latch plate 18. Latch plate 18 is retained by screws 24*a*, 24*b* and washers 26*a*, 26*b*. The screws 24*a*, 24*b* thread though slots 20*a*, 20*b* and into the posts 22*a*, 22*b*. When fully inserted, the screws 24*a*, 24*b* clamp washers 26*a*, 26*b* against the posts 22*a*, 22*b*. Latch plate 18 is then trapped between the washers 26*a*, 26*b* and the stock structure at the base of the posts 22*a*, 22*b*.

Latch plate 18 is slidably attached to the butt-end of stock 16. Its slots 20*a*, 20*b* are longer than the diameter of screws 24*a*, 24*b*. Consequently, the latch plate 18 is free to float vertically in the stock 16, with its vertical range being limited by the shape of the slots 20*a*, 20*b*. Similarly, forward and backward motion of the latch plate 18, within the slots 20*a*, 20*b*, is limited by the clearance between the washers 26*a*, 26*b* and the stock structure at the base of the posts 22*a*, 22*b*. The posts 22*a*, 22*b* also prevent lateral movement of the latch plate 18.

Pushbutton 17 is an integral part (i.e., an end portion) of the latching means 14. It protrudes through a hole preferably in the bottom of stock 16. An extension spring 30 is attached between the latch plate 18 and the inside of the stock 16. A loop-end 32*a* of the extension spring 30 hooks onto a protrusion 34 on the stock 16. Another loop-end 32*b* of spring 30 hooks into an eye 35 on the latch plate 18. The extension spring 30 then keeps the latch plate 18 biased down. When the recoil pad 13 is not attached, the downward travel of the latch plate 18 is limited by the length of the slots 20*a*, 20*b*. Slots 20*a*, 20*b* contact the posts 22*a*, 22*b* preventing the integral release button 17 of latch plate 18 from protruding beyond the outer surface of stock 16.

In addition to the slots 20*a*, 20*b*, the latch plate 18 also has two pear-shaped holes 36*a*, 36*b*, which extend longitudinally in the plate. See FIGS. 6, 8, 8A. These pear-shaped holes are designed to interact with and capture connecting posts 38*a*, 38*b*, which extend outwardly from a recoil pad substrate 40 (attached within a recess in the base of pad 13). Connecting posts 38*a*, 38*b* have wider conical ends, like mushroom caps. See FIGS. 9, 9A.

Substrate 40 (see FIG. 9) preferably is molded plastic. It has protruding ribs (e.g., 42*a*, 42*b*) that pick up the interior contour (not shown) of the stock 16, preventing relative motion between the pad assembly 12 and the stock 16 when the recoil pad assembly 12 is fitted to the stock. Substrate 40 also has a center rib 44 with a tapered end 46.

As the recoil pad assembly 12 is pushed onto stock 16, the pad assembly's tapered end 46 engages the inner contour of the stock and pushes the pad assembly upwards (relative to a longitudinal axis of the firearm). At the same time, the conical ends of connecting posts 38*a*, 38*b* pass through the circular portions of the pear-shaped holes 36*a*, 36*b* in the latch plate 18. As they pass through, the conical ends push the latch plate 18 upwards against the force exerted by the extension spring 30. When the recoil pad assembly 12 is tight against the stock 16, the conical ends have passed fully through the pear-shaped holes 36*a*, 36*b*, and the spring-biased latch plate 18 has snapped down behind the conical ends. The conical ends then cannot pass back through the smaller portions of the pear-shaped holes, and the recoil pad assembly 12 (and recoil pad 13) is held in place.

Pushing on the release button 17 moves the latch plate 18 upwards against the extension spring 30 force and aligns the larger circular portions of pear-shaped holes 36*a*, 36*b* with the conical ends of the connecting posts 38*a*, 38*b*. The conical ends can now pass back through the larger circular portions of the pear-shaped holes, allowing the pad assembly 12 to be removed.

When the pad assembly 12 is latched onto stock 16, the recoil pad substrate 40 is out-of-sight. See FIGS. 4, 5. No exposed portion of the interchangeable recoil pad assembly 12 extends forward of the butt-end other than the release button 17 (see FIG. 5).

Applicants' invention allows shooters to quickly change the recoil pad of a shotgun or rifle without tools or other implements. That allows shooters to compensate for changes in clothing thickness; and it allows for correct position of the firearm among multiple users of differing anatomical dimension.

It should be understood that obvious structural modifications can be made without departing from the spirit or scope of the invention. For example, the Quick Connect/Disconnect Recoil Pad also could incorporate a leaf spring or elastic band in place of the coil spring and possibly variant post end shapes for the connecting posts including shapes other than right-cones, and spherical or cylindrical post ends.

What is claimed is:

1. An apparatus for removably connecting a recoil pad onto a gun stock, wherein the apparatus comprises:

a. an interchangeable recoil pad assembly having a recoil pad; and b. a spring-loaded latching means, attached to a butt-end of the gun stock, for latching the recoil pad assembly onto the stock and for selectively unlatching the pad assembly without the use of tools;

c. wherein the latching means comprises:

i. a release button housed in the stock;

ii. a latch plate slidably attached to the butt-end of the stock, wherein the release button is an integral end portion of the plate; and iii. a spring attached to the firearm stock and to the latch plate, thereby applying a biasing force tending to maintain the latch plate in a latched position.

2. The apparatus of claim 1 wherein the spring is a coil spring.

3. The apparatus of claim 2 wherein the latch plate has two pear-shaped holes, with circular portions, longitudinally extending in the latch plate.

4. The apparatus of claim 3 wherein the recoil pad assembly comprises:

a. the recoil pad; and b. a recoil pad substrate, attached to the recoil pad, having connecting posts extending outwardly with conical ends adapted in size and shape to protrude through the circular portions of the pear-shaped holes.

* * * * *